US006935383B2

(12) United States Patent
Schwartz

(10) Patent No.: US 6,935,383 B2
(45) Date of Patent: Aug. 30, 2005

(54) COMBINATION WEAVE USING TWISTED AND NONTWISTED YARN

(75) Inventor: Larry Schwartz, Boca Raton, FL (US)

(73) Assignee: Sun Isle Casual Furniture, LLC, Franklin Lakes, NJ (US)

( * ) Notice: Subject to any disclaimer, the term of this patent is extended or adjusted under 35 U.S.C. 154(b) by 98 days.

(21) Appl. No.: 10/158,629

(22) Filed: May 30, 2002

(65) Prior Publication Data

US 2003/0221741 A1 Dec. 4, 2003

Related U.S. Application Data

(63) Continuation-in-part of application No. 10/123,943, filed on Apr. 17, 2002, now Pat. No. 6,725,640, which is a continuation-in-part of application No. 10/073,634, filed on Feb. 11, 2002, now Pat. No. 6,705,070, which is a continuation-in-part of application No. 10/062,905, filed on Jan. 31, 2002, now Pat. No. 6,625,970

(60) Provisional application No. 60/336,819, filed on Dec. 5, 2001.

(51) Int. Cl.[7] ..... D03D 15/02

(52) U.S. Cl. ..... 139/426 TW; 139/383 R; 139/420 A

(58) Field of Search ..... 139/426 TW, 383 R, 139/420 A, 426 R

(56) References Cited

U.S. PATENT DOCUMENTS

| | | | | |
|---|---|---|---|---|
| 2,321,746 A | | 6/1943 | Heymann | |
| 2,400,276 A | * | 5/1946 | Whitman | 442/189 |
| 2,713,360 A | * | 7/1955 | Bloch et al. | 139/391 |
| 3,101,522 A | | 8/1963 | Hooper et al. | |
| 3,488,934 A | | 1/1970 | MacDonald | |
| 3,559,390 A | | 2/1971 | Staschewski | |
| 3,691,748 A | | 9/1972 | Buzano | |
| 3,792,899 A | | 2/1974 | Rocchia et al. | |

(Continued)

FOREIGN PATENT DOCUMENTS

| | | |
|---|---|---|
| DE | 19516174 | 11/1996 |
| EP | 0210710 | 2/1987 |
| EP | 03732311 | 6/1990 |
| GB | 1047156 | 11/1980 |
| JP | 57133212 | 8/1982 |
| JP | 11179705 | 7/1999 |

*Primary Examiner*—John J. Calvert
*Assistant Examiner*—Robert H. Muromoto, Jr.
(74) *Attorney, Agent, or Firm*—Lerner, David, Littenberg, Krumholz & Mentlik, LLP

(57) ABSTRACT

An article of furniture is made from elongated polymer filaments. The polymer filaments may be monofilaments or plural filaments, which are twisted together and woven with polymer strands of non-twisted yarn to form a woven portion of material. The woven portion can be used to form the seat or back rest of a seating article of furniture for indoor or outdoor use.

26 Claims, 6 Drawing Sheets

U.S. PATENT DOCUMENTS 3,867,967 A 2/1975 Rocchia et al.
3,948,702 A 4/1976 Theissen
3,958,406 A 5/1976 Corbiere
4,123,893 A 11/1978 Chambley et al.
4,155,394 A 5/1979 Shepherd et al.
4,168,606 A 9/1979 Callander
4,231,834 A 11/1980 Trejo Gonzalez
4,246,747 A 1/1981 Plunkett et al.
4,289,564 A 9/1981 Hanaford et al.
4,295,235 A 10/1981 Dietz
4,395,029 A 7/1983 Davis et al.
4,467,839 A 8/1984 Westhead
4,469,738 A 9/1984 Himelreich, Jr.
4,544,594 A 10/1985 Li et al.
4,586,751 A 5/1986 McGuire
4,626,390 A 12/1986 Li et al.
4,744,935 A 5/1988 Priaroggia et al.
5,084,221 A 1/1992 Matsuno et al.
5,236,775 A * 8/1993 Swoboda et al. ..... 428/219
5,284,380 A 2/1994 Gehry
5,466,514 A * 11/1995 Kataoka et al. ..... 442/81
5,507,997 A 4/1996 Evain
5,700,490 A 12/1997 Meise
5,704,690 A 1/1998 Schwartz
D395,171 S 6/1998 Schwartz
5,807,794 A 9/1998 Knox et al.
5,829,241 A 11/1998 McAllister et al.
5,845,970 A 12/1998 Schwartz
5,858,885 A 1/1999 Hamilton et al.
D409,001 S 5/1999 Schwartz
5,925,727 A 7/1999 Onda et al.
6,035,901 A 3/2000 Stumpf et al.
6,074,751 A 6/2000 Murakami et al.
6,117,548 A 9/2000 Swers et al.
6,120,097 A 9/2000 Perry et al.
6,244,031 B1 6/2001 Murakami et al.
6,264,674 B1 7/2001 Washington et al.
6,523,578 B1 * 2/2003 Schneider et al. ... 139/426 TW
6,537,640 B1 * 3/2003 Nakamura et al. ..... 428/92
2002/0144497 A1 10/2002 Scheunemann

* cited by examiner

COMBINATION WEAVE USING TWISTED AND NONTWISTED YARN

CROSS REFERENCE TO RELATED APPLICATIONS

The present application is a continuation-in-part of U.S. patent application Ser. No. 10/123,943, filed Apr. 17, 2002, now U.S. Pat. No. 6,725,640 which is a continuation-in-part of U.S. application Ser. No. 10/073,634, filed Feb. 11, 2002, now U.S. Pat. No. 6,705,070 which is a continuation-in-part of U.S. patent application Ser. No. 10/062,905, filed Jan. 31, 2002, now U.S. Pat. No. 6,625,970 entitled "Method of Making Furniture With Synthetic Woven Material" which claims the benefit of United States Provisional Application No. 60/336,819, filed Dec. 5, 2001, the disclosures of which are hereby incorporated by reference herein.

BACKGROUND OF THE INVENTION

The present invention relates in general to the field of furniture constructed with synthetic woven material, and more particularly, to synthetic woven material manufactured from combination yarns including twisted yarns and non-twisted yarns.

Natural wicker has been used in the manufacture of furniture, baskets and other articles for many centuries. Natural wicker articles are manufactured from the twigs or branches of various plants that are first soaked in water in order to make them pliable, then woven to form into the article and finally allowed to dry. Furniture manufactured from wicker offers greater comfort than furniture manufactured from some other materials because of wicker's inherent compliancy. Further, wicker is light weight and reasonably strong, making it an important material in the manufacture of furniture.

The popularity of wicker furniture has increased significantly. The casual, informal appearance of wicker has made it especially popular for use in enclosed porches and other informal settings in homes, hotels and other establishments. Natural wicker, however, has had limited use in the outdoor furniture market, including patio furniture, pool furniture and the like. This is because natural wicker softens and weakens when wet, and is more susceptible to rotting and mildew than many other natural and man-made furniture materials.

Woven wicker typically comprises a weft yarn, i.e., a yarn running straight through the woven material, and a warp yarn, i.e., a yarn that is woven around the weft yarn. Numerous styles of weave are used in the manufacture of wicker furniture. The various styles of weave result in a different look, feel, strength and weight of the finished woven product. In a simple wave pattern, the weft yarns are spaced apart and arranged parallel to each other. The warp yarns are woven over and under alternating weft yarns. Adjacent warp yarns pass on opposite sides of a given weft yarn.

Polymer yarns have also been used to manufacture wicker-like furniture. By way of example, a polymer yarn is known which is constructed as an elongated body, such as of indeterminate length, having a core surrounded by a polyvinylchloride (PVC) outer coating, for example, foamed and non foamed PVC material. Foamed PVC material gives greater volume with less material. The outer coating may be formed of other synthetic materials such as polyamides, polyesters and the like. The yarn is typically made in a single step using a coextrusion process, as is known in the art. The inner core may include a single filament of polyester, or may include a plurality of polyester filaments bundled to form a single core. In addition, the core may be formed of other materials than polyester, monofilament or stranded, such as polyamides and the like. The core is designed to give the yarn greater mechanical strength over yarns formed only of polymer material.

The polymer yarn being constructed from foamed PVC material results in a lack of uniformity in the foaming of the PVC material during the extrusion process. This produces a yarn which lacks a uniform cylindrical appearance. Specifically, the outer surface of the yarn is deformed, such as by having undulations, mounds and/or depressed areas along the length of the yarn. The deformed shape of the outer surface of the yarn results in the yarn having a more natural look to that of real wicker. It is also known to provide the exterior surface of the polymer yarn with one or more random stripes of a contrasting color and/or one or more random grooves. The stripes and grooves can be continuous and/or intermittent along the exterior surface of the yarn. The yarn, however, can also have a more uniform cylindrical shape, as well as other shapes such as square, oval, triangular and the like. Polymer yarns as thus far described are known from U.S. Pat. Nos. 5,704,690; 5,845,970; and 6,179,382, as well as U.S. Design Pat. Nos. 395,171; and 409,001, the disclosures of which are incorporated herein by reference. As in the case of natural wicker, polymer yarns have been woven into a woven material, which has been used in the manufacture of casual furniture suitable for the outdoor furniture market, including patio furniture, as well as for indoor use.

There is disclosed the application of twisted synthetic yarns for use in manufacturing synthetic woven material for furniture articles in Applicant's co-pending application Ser. No. 10/123,943, entitled "Method of Making Furniture with Synthetic Woven Material" which was filed on Apr. 17, 2002, the disclosure of which is incorporated herein by reference. The application discloses various methods of heat setting twisted yarns and forming same into a woven material for use in forming, for example, seat and back portions of a furniture article. The twisted yarns are used as both the weft yarns and the warp yarns to form the woven portion, which is adhered to a frame of a furniture article. As the twisted yarns generally have a non-smooth exterior surface by virtue of their twisted nature, their direct contact with a person's skin may be considered by some to be uncomfortable. It has therefore been found desirable to provide an improvement in the manufacture of woven portions from synthetic twisted yarns, which provide improved comfort to the user of the furniture article.

SUMMARY OF THE INVENTION

In accordance with one embodiment of the present invention there is described a weave comprising a plurality of elongated non-twisted polymer wrap strands, and a plurality of elongated twisted polymer weft strands.

In accordance with another embodiment of the present invention there is described a woven portion adapted for use with an article of furniture, said woven portion comprising a plurality of elongated non-twisted polymer warp strands, each of said warp strands comprising a single polymer strand, a plurality of elongated twisted polymer weft strands, each of said weft strands comprising at least two polymer strands twisted together over their entire length, said weft strands and said warp strands having an exposed upper surface, wherein said exposed upper surface of said warp strands arranged above said exposed upper surface of said weft strands in said woven portion.

In accordance with another embodiment of the present invention there is described an article of furniture comprising a frame having the shape of an article of furniture, and a weave of polymer material attached to said frame, said weave comprising a plurality of elongated non-twisted polymer wrap strands and a plurality of elongated twisted polymer weft strands.

In accordance with another embodiment of the present invention there is described an article of furniture comprising a frame having the shape of an article of furniture, and a woven portion of polymer material attached to said frame, said woven portion comprising plurality of elongated non-twisted polymer warp strands, each of said warp strands comprising a single polymer strand, a plurality of elongated twisted polymer weft strands, each of said weft strands comprising at least two polymer strands twisted together over their entire length, said weft strands and said warp strands having an exposed upper surface, wherein said exposed upper surface of said warp strands is arranged above said exposed upper surface of said weft strands within said woven portion.

In accordance of another embodiment of the present invention, there is described a method of making an article of furniture comprising providing a frame having the shape of an article of furniture, providing a plurality of weft yarns of twisted polymer strands, weaving a plurality of warp yarns of non twisted polymer strands with the plurality of weft yarns to form a woven material, adhering the plurality of weft yarns and warp yarns to the frame, wherein the plurality of weft yarns and the warp yarns have an exposed upper surface, wherein the exposed upper surface of the warp yarns are arranged above the upper surface of adjacent weft yarns.

BRIEF DESCRIPTION OF THE DRAWINGS

The above description, as well as further objects, features and advantages of the present invention will be more fully understood with reference to the following detailed description of a combination weave using twisted and non-twisted yarn, when taken in conjunction with the accompanying drawings, wherein.

DETAILED DESCRIPTION

In describing the preferred embodiments of the subject matter illustrated and to be described with respect to the drawings, specific terminology will be resorted to for the sake of clarity. However, the invention is not intended to be limited to the specific terms so selected, and is to be understood that each specific term includes all technical equivalence which operate in a similar manner to accomplish a similar purpose.

Figure 1:
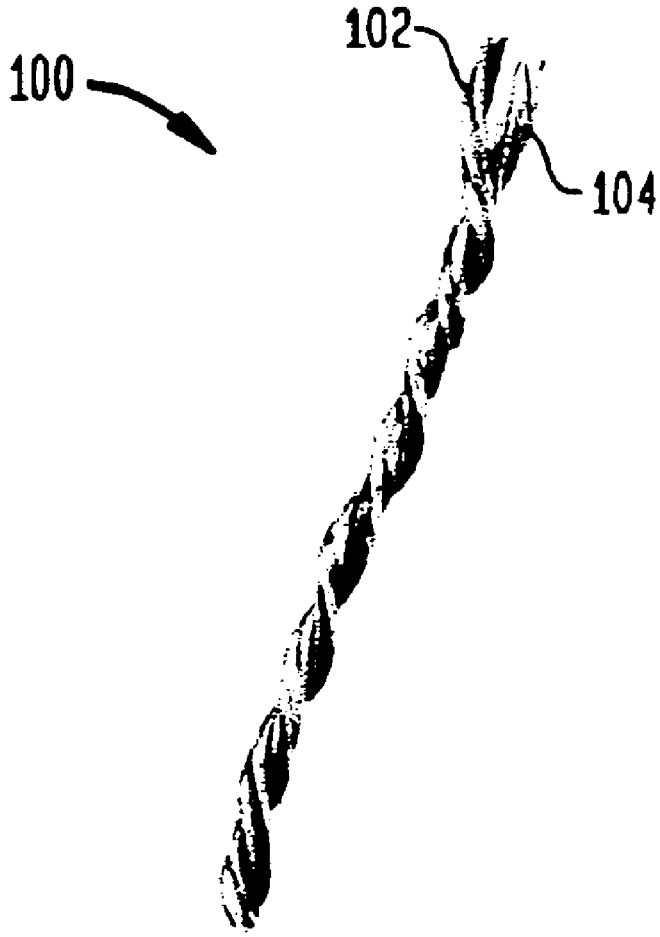
FIG. 1 is a top plan view of a portion of a twisted polymer yarn.

Referring to the drawings, wherein like reference numerals represent like elements, there is shown in FIG. 1 in accordance with one embodiment of the present invention a twisted yarn of indeterminate length designated generally by reference numeral 100 which may be heat set in accordance with the invention disclosed in the aforementioned patent application. The twisted yarn 100 is made of two strands or filaments 102, 104 of polymer material of the type and construction as described in the aforementioned patents which have been incorporated herein by reference. However, other strands or filaments of polymer material of a different construction or polymer material are also contemplated for use in producing a twisted yarn 100 or a weave of woven material in accordance with the present invention. Although the twisted yarn 100 has been illustrated as comprising two strands 102, 104, it is to be understood that the twisted yarn can be constructed from greater than two strands if so desired. In addition, it is not required that the strands 102, 104 be identical in size, shape and/or surface configuration.

Figure 2:
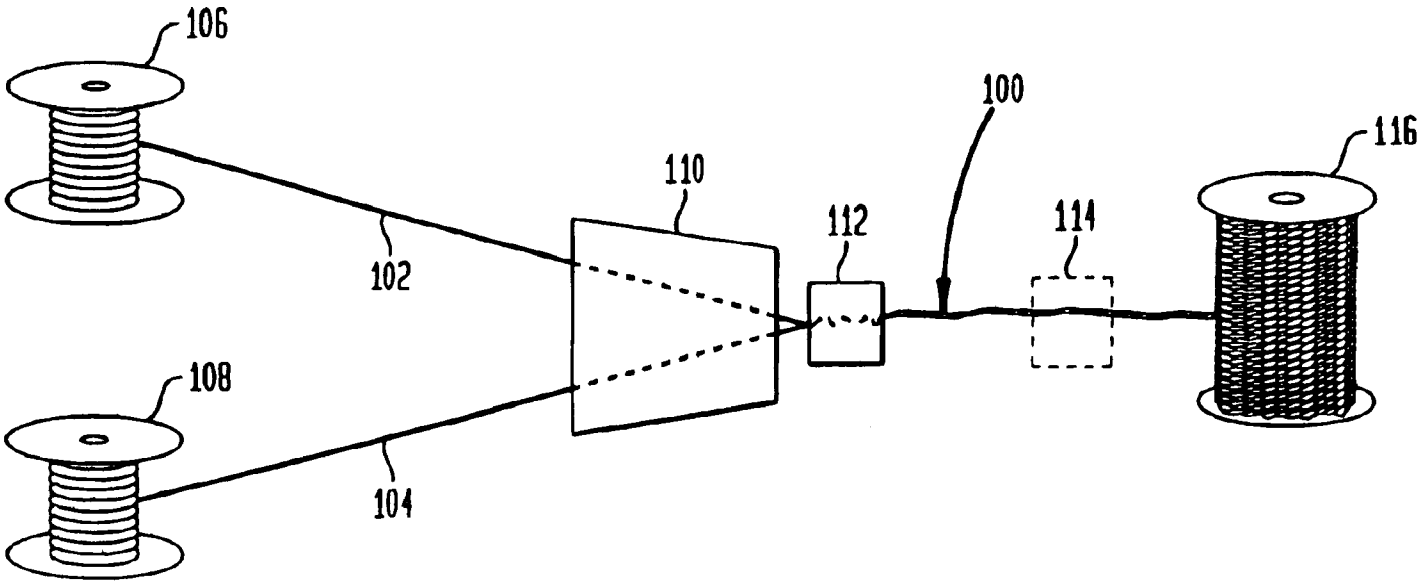
FIG. 2 is a diagrammatic illustration showing the fabrication process of heat setting the twisted polymer yarn as shown in FIG. 1.

Referring now to FIG. 2, there will be described one process of manufacturing a heat set twisted yarn 100. As shown, there is provided a source 106 of a continuous length of a strand 102 of polymer material. A similar source 108 is provided for a continuous length of another strand 104 of polymer material. Generally, the sources 106, 108 will be in the nature of a spool of an indeterminate length of the strands 102, 104 of the polymer material.

The individual strands 102, 104 are fed concurrently from the spools into an oven 110 which is heated to a predetermined temperature. In the case of PVC material, an oven temperature of about 270° F. has been found suitable for use in accordance with the present invention. The temperature of the oven 110 will take into consideration the type of the polymer material forming the strands 102, 104, as well as the linear rate in which the strands pass through the oven, for example, the residence time in the oven. Based upon the oven temperature and residence time of the strands 102, 104 within the oven 110, at least the outer surface of the strands will reach about their softening temperature. Accordingly, lower temperatures with longer residence times and higher temperatures with shorter residence times are contemplated. It is preferable that the temperature of the strands 102, 104 do not reach their melting temperature where they would lose their general shape. However, a slight melting of the outer surface region of the strands 102, 104 is contemplated within the scope of the present invention. Although the process has been described as heating both of the strands 102, 104, it is contemplated to adhere the strands together by heating only one of the strands. The other strand may be at room temperature or heated to a temperature less than its softening temperature.

It can be appreciated that the temperature of the oven will vary according to the particular polymer material forming the strands 102, 104, as well as the residence time for the strands within the oven. For polymer material most suitable for use in accordance with the present invention, a temperature range of 200 to 375° F., and more preferably about 250 to 300° F. is contemplated. However, as the basis for determining the oven temperature and residence time have been described herein, it is to be understood that other temperatures can be selected for suitable use with any polymer material in which to form a twisted yarn from strands 102, 104.

As the heated strands 102, 104 exit the oven 110, they pass through a conventional filament twisting apparatus 112.

The twisting apparatus 112 is operative for twisting the two strands 102, 104 together to form the twisted yarn 100 as best shown in FIG. 1. The twisting apparatus 112 may be of any suitable construction such as known in the rope art where continuous lengths of filaments are twisted together. During the twisting process, there is a degree of compression between the strands 102, 104 which, due to their heated temperature, results in the strands bonding together to generally form a single integral strand having a twisted configuration as shown in FIG. 1. It is to be understood that it is not a requirement that the strands 102, 104 be integral over their entire length, but rather, have contiguous intermittent portions over their length which are joined together whereby the twisted yarn 100 is prevented from unraveling during the subsequent weaving process.

The twisted yarn 100 is subject to air cooling, or optionally, passed through a cooling device 114. The cooling device 114 may include a source of blowing ambient air, or air chilled to aid in bringing the twisted yarn 100 to room or ambient temperature. The resulting twisted yarn 100 is subsequently wound upon a spool 116. It is also contemplated that the twisting apparatus 112 may be positioned before the oven 110, as well as providing separate ovens 110 for each strand 102, 104 operating at the same or different temperature. Different process conditions are contemplated where the strands 102, 104 are of a different construction, composition or size.

The individual strands 102, 104 may be formed by hot extrusion of polymer material through a die. It is therefore contemplated that the strands 102, 104, while in a heated state after extrusion, may be twisted in the twisting apparatus 112, thereby eliminating the need for a separate oven 110. Depending upon the exit temperature of the strands 102, 104 from the extruder, the strands may be allowed to air cool or provided with a separate cooling device 114 for either or both of the strands prior to twisting.

Figure 3:
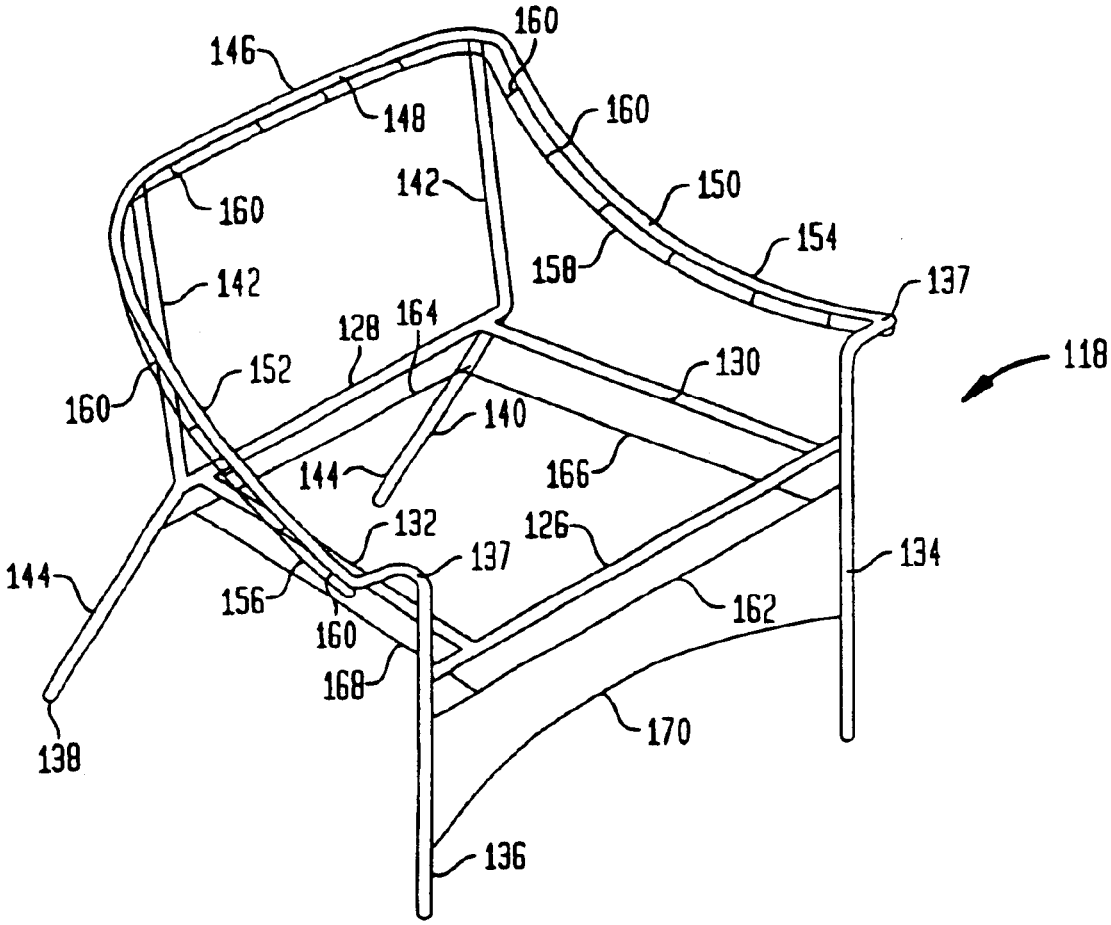
FIG. 3 is a perspective view of a skeletal frame of an article of furniture.
Figure 4:
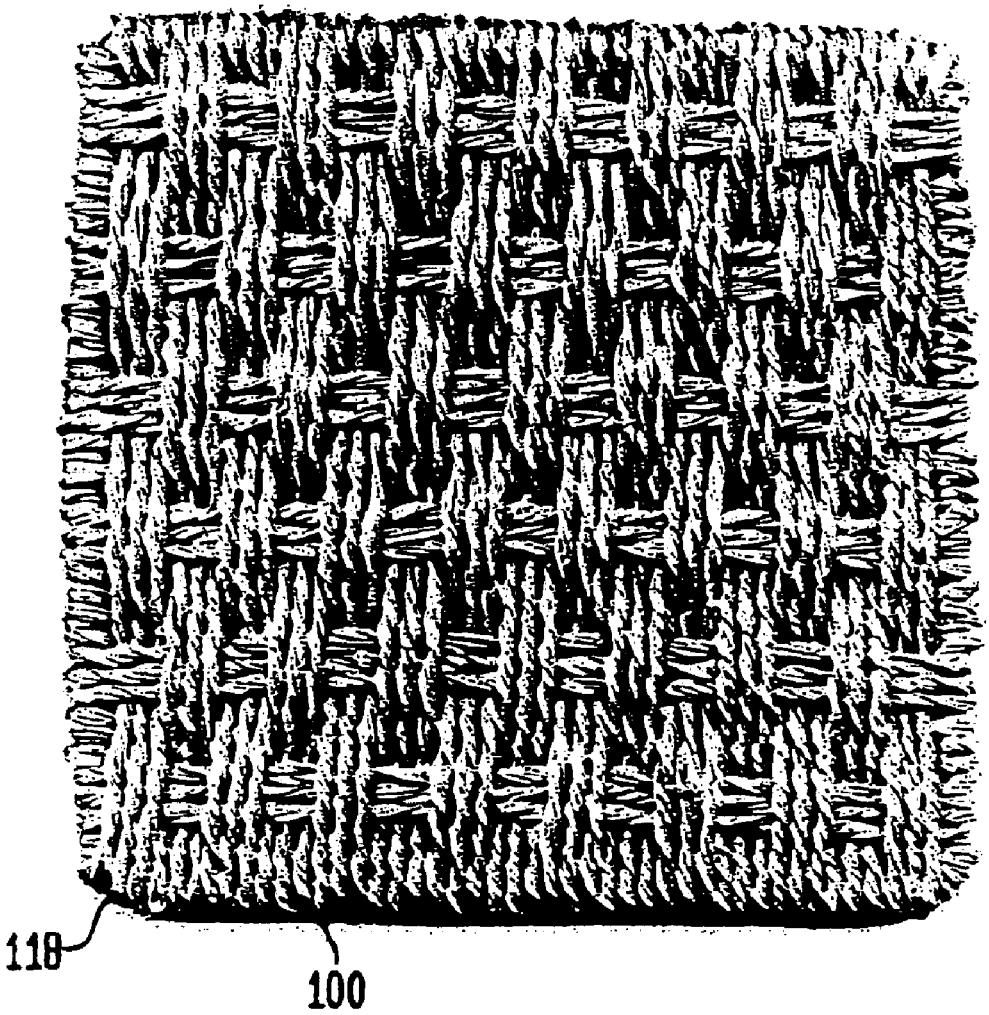
FIG. 4 is a perspective view of an article of furniture in the nature of a chair to which there is attached the woven material as shown in FIG. 5.

There will now be described one example of using twisted yarn 100 in forming a woven portion in constructing an article of furniture such as a chair. In accordance with the present invention, strands of twisted yarn 100 will be woven with non-twisted strands of polymer yarn to form woven material for forming portions of the article. It is to be understood that other furniture items such as couches, tables, benches, stools, trunks and the like can also be produced in accordance with the teachings of the present invention. As shown in FIGS. 3 and 4, a chair 120 can be produced from a rigid skeletal frame 118 which will be covered with a weave of woven material produced from a composite weave of twisted and non-twisted yarn.

The frame 118, by way of illustration only, provides an arm chair with a seat, a back rest, a pair of front legs, a pair of back legs and a pair of side arms. The seat 124 (see FIG. 4) is delineated by a connecting front member 126, a parallel spaced apart back member 128 and a pair of parallel spaced apart side members 130, 132. The front legs 134, 136 are constructed as parallel spaced apart vertical members joined to the free ends of the front member 126 and have outwardly turned extensions 137 providing the front legs with an L-shape. The front legs 134, 136 are arranged generally vertical to the floor as viewed from the front and side of the chair 120.

The back legs 138, 140 are constructed from an angular member attached to the free ends of the back member 128. The back legs 138, 140 have generally parallel spaced apart upper members 142 extending vertically from the back member 128 as viewed from the front and side and generally parallel spaced apart lower members 144. The lower members 144 are arranged at a rearwardly extending angle as viewed from the side and extend generally vertical from the back member 128 as viewed from the rear of the chair 120.

A generally U-shaped member 146 includes a center section 148 connected across the free ends of the upper members 142 of the back legs 138, 140 and a pair of curved spaced apart side arm members 150, 152 forming the side arms 154, 156 of the arm chair. The free ends of the side arm members 150, 152 are attached to the free ends of the extensions 137 of the respective front legs 134, 136. The side arm members 150, 152 are spaced apart wider at their mouth where they connect to the extensions 137 then where they form the center section 148. This arranges the side arms 154, 156 outwardly of the side members 130, 132. The upper members 142 of the back legs 138, 140, the back member 128 and center section 148 delineate the back 178 of the chair 120.

A secondary frame can be used to provide attachment support for the woven material utilized in covering the frame 118. Specifically, a generally U-shaped elongated rod 158 having a shape conforming substantially to the shape of the U-shaped member 146 is connected thereto in underlying relationship by means of a plurality of spaced apart ribs 160. Another secondary support frame is positioned between the front and back legs 134, 136, 138, 140 underlying the seat 124. This secondary frame is constructed from a front rod 162 connected between the front legs 134, 136, a back rod 164 connected between the back legs 138,140 and a pair of side rods 166, 168 arranged in parallel spaced apart relationship connected between the front rod 162 and back rod 164 inwardly of their terminal ends. An additional front rod 170 may be positioned between the front legs 134, 136 underlying front rod 162.

Figure 5:
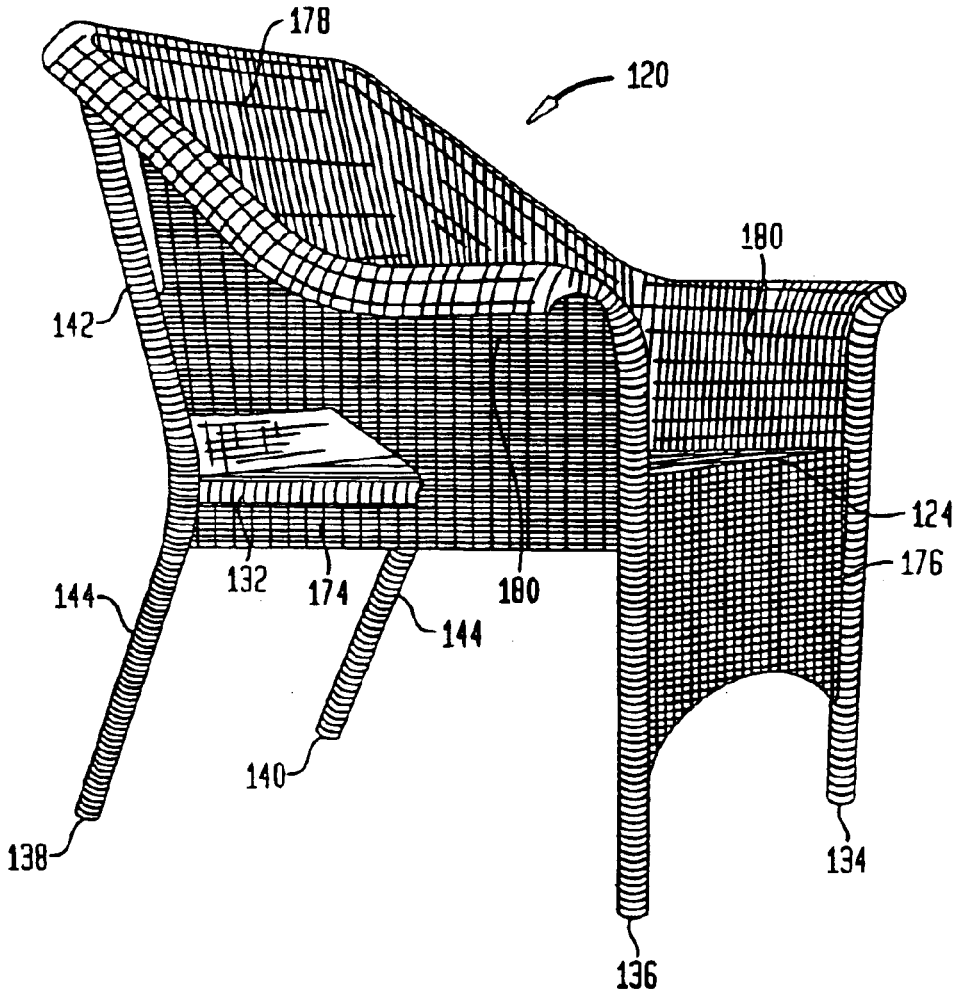
FIG. 5 is a perspective view of woven material constructed by weaving a combination of twisted and non-twisted polymer yarns in accordance with one embodiment of the present invention.

Referring now to FIGS. 4 and 5, the frame 118 is covered by weaving the twisted yarn 100 in combination with strands of non-twisted yarn into a woven material to form panels of woven material directly on the frame. The non-twisted yarn can have any desired construction such as disclosed in the aforesaid patents, or as disclosed by strands 102, 104, or as may be known generally. A plurality of individual strands of twisted yarn 100, i.e., weft yarn, are attached to various portions of the frame 118, for example, to the secondary frame as previously described. The individual strands of the non-twisted yarn 101, i.e., warp yarn are woven with the twisted yarn 100, as they are attached to the frame 118 into a predetermined weave pattern. As shown in FIG. 5, the weave pattern is a 4×4 pattern of weft and warp strands. However, the pattern may include any number of weft and warp strands of twisted and non-twisted yarn 100, 101, for example, a 2×2, 5×5, 6×6, 10×10, etc. In addition, it is not required that the woven material be symmetrical. In this regard, it is contemplated that the weave may comprise a 2×3, 3×5, 4×7, 2×5, 2×6, etc. weft and warp woven pattern. In addition, the twisted and non-twisted yarn 100, 101, may be woven into integral designs. As such, the resulting panels of woven material, as shown in FIG. 5, are woven in situ directly on the frame 118.

As the twisted yarn 100 is formed from at least two strands 102, 104 of polymer material, it is preferred that the diameter of the strands be smaller than the diameter of the non-twisted yarn 101. In the preferred embodiment, the overall diameter of the twisted yarn 100 will have a similar overall diameter to a single strand of the non-twisted yarn 101. This will result in a more uniform appearance to the woven portion. However, it is not a requirement that the diameter or shape of the twisted yarn 100 and non-twisted yarn 101 be the same. By providing variations in the size, shape and/or configuration of the twisted yarn 100 and non-twisted yarn 101, various aesthetic appearances can be achieved.

During the weaving process, the twisted yarn 100 constitutes the weft yarn, while the non-twisted yarn 101 constitutes the warp yarn. As shown in FIG. 5, the non-twisted yarn 101 is woven about the twisted yarn 100 as is known in the weaving art. This results in the exposed surface of the non-twisted yarn 101 being generally raised above the exposed surface of the twisted yarn 100. This provides a more comfortable surface portion for the woven material as the surface of the non-twisted yarn 101 is predominantly exposed for contact with the skin of an individual occupying the article of furniture.

Referring to FIG. 4, there is illustrated a chair 120 which has been fabricated by the weaving of the twisted yarn 100 and non-twisted yarn 101 into woven material which is attached to the frame 118. As shown, the chair 120 includes a seat portion 124, a front skirt portion 176, a back rest portion 178 and side portions 180. The front and back legs 134, 136, 138, 140 are wrapped with a continuous length of twisted yarn 100. In this regard, the twisted yarn 100 or non-twisted yarn 101 is wrapped in a compact spiral around the length of each leg without weaving.

Figure 6:
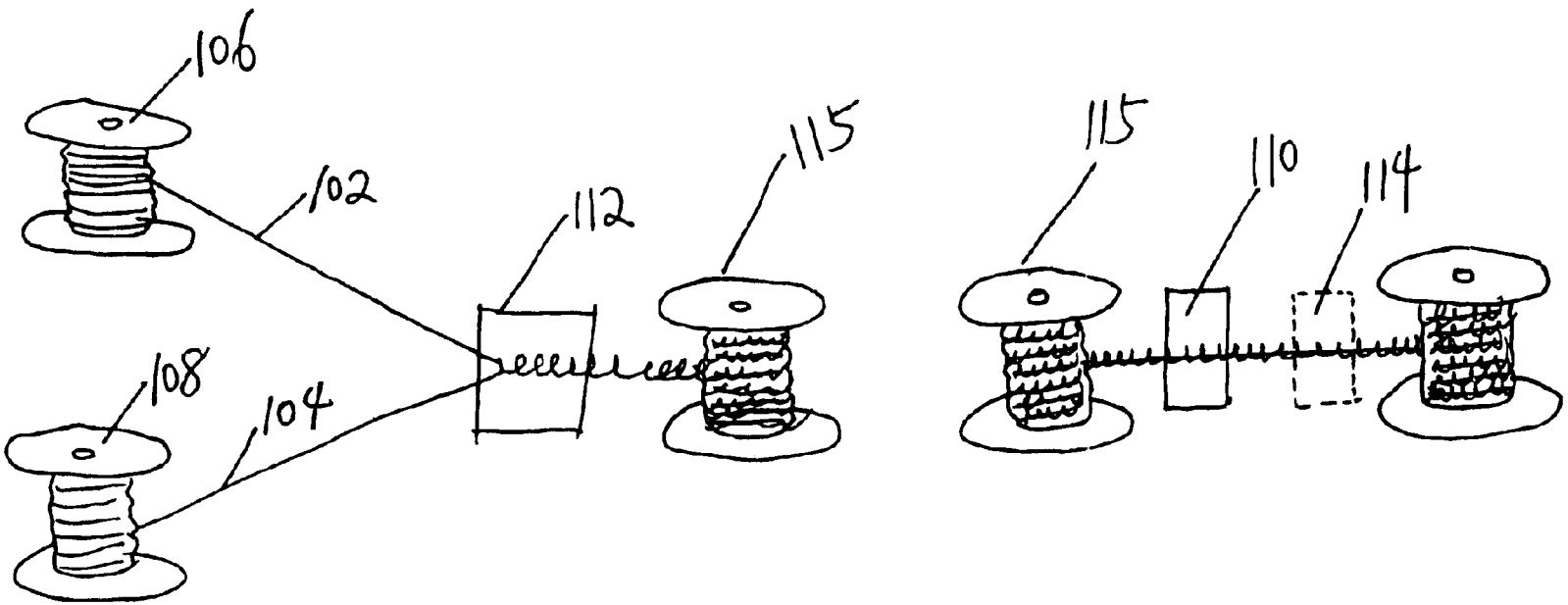
FIG. 6 depicts another process of heat setting twisted polymer yarn.
Figure 1:
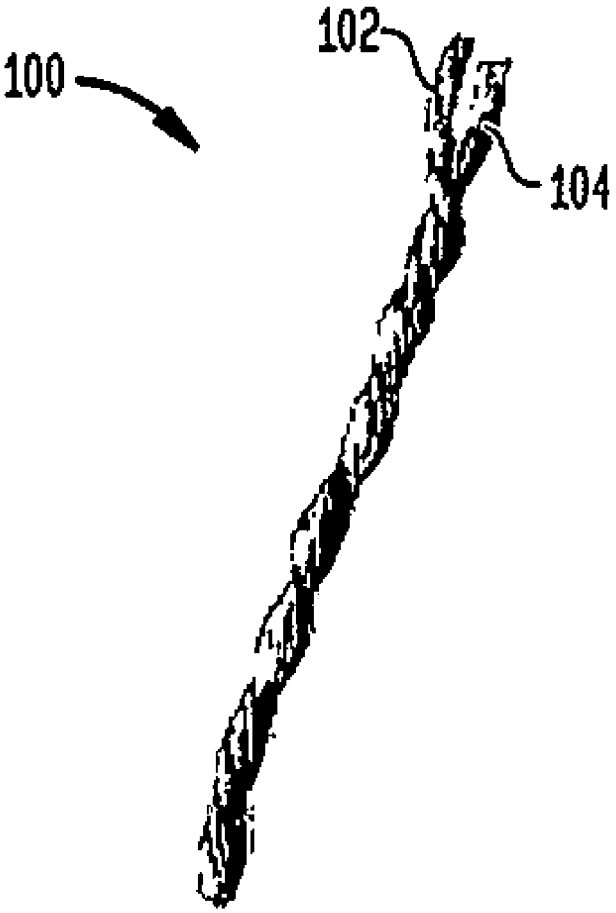
Figure 2:
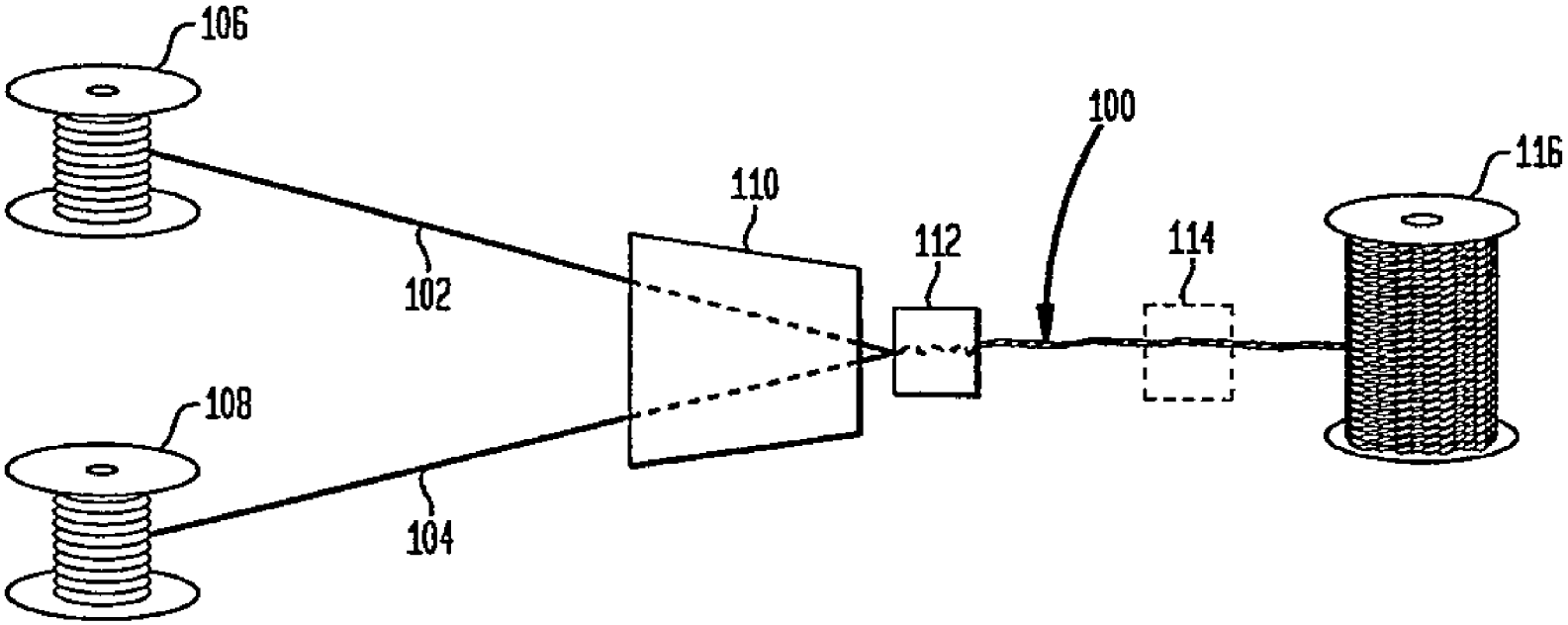
Figure 3:
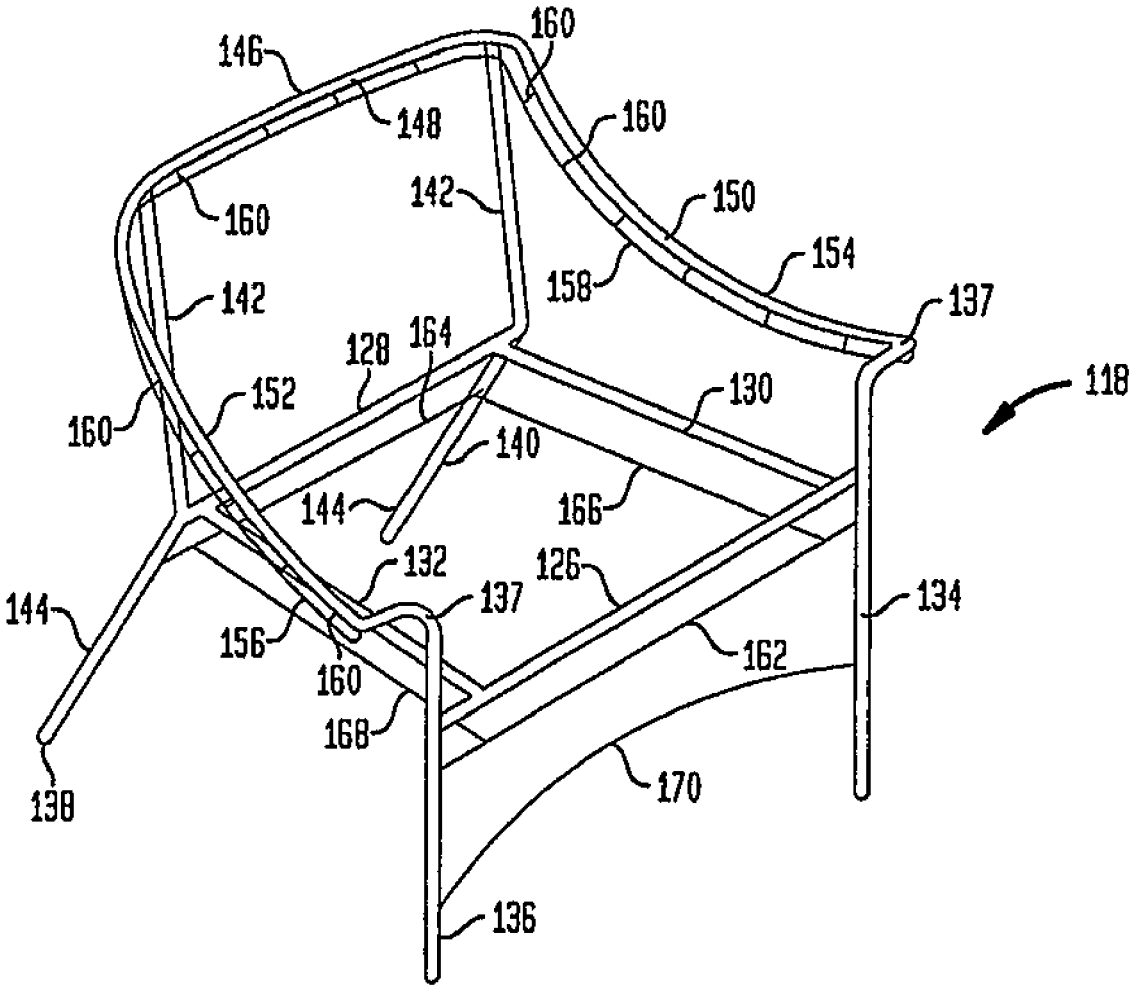
Figure 4:
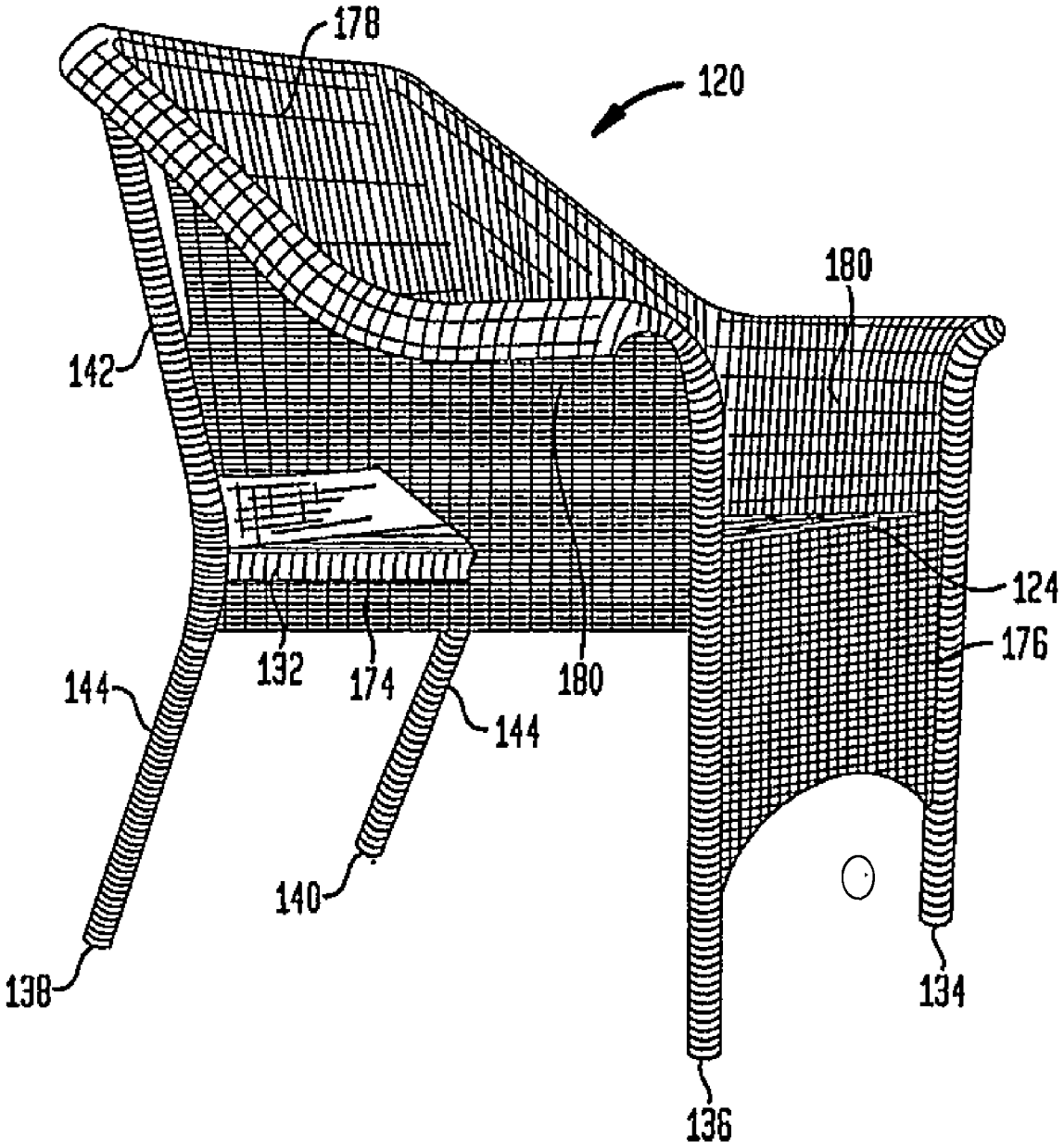
Figure 5:
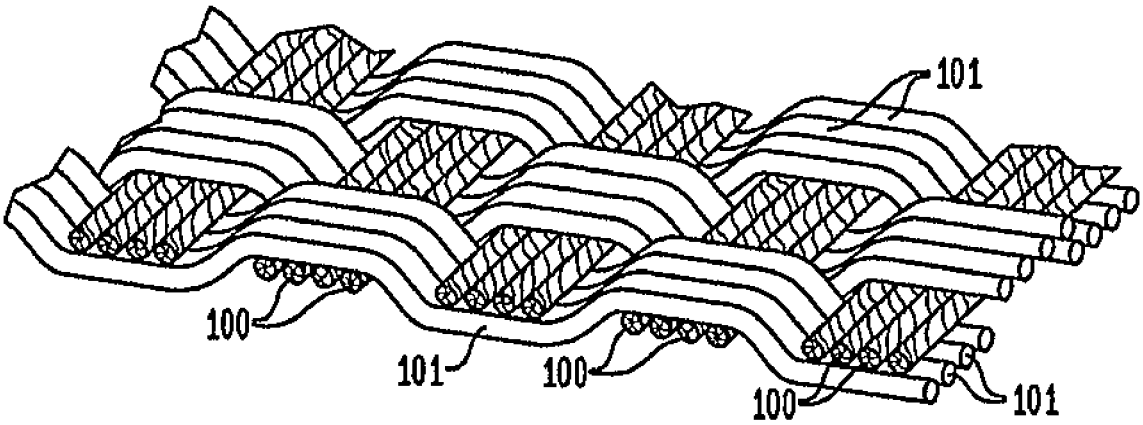
Figure 6:
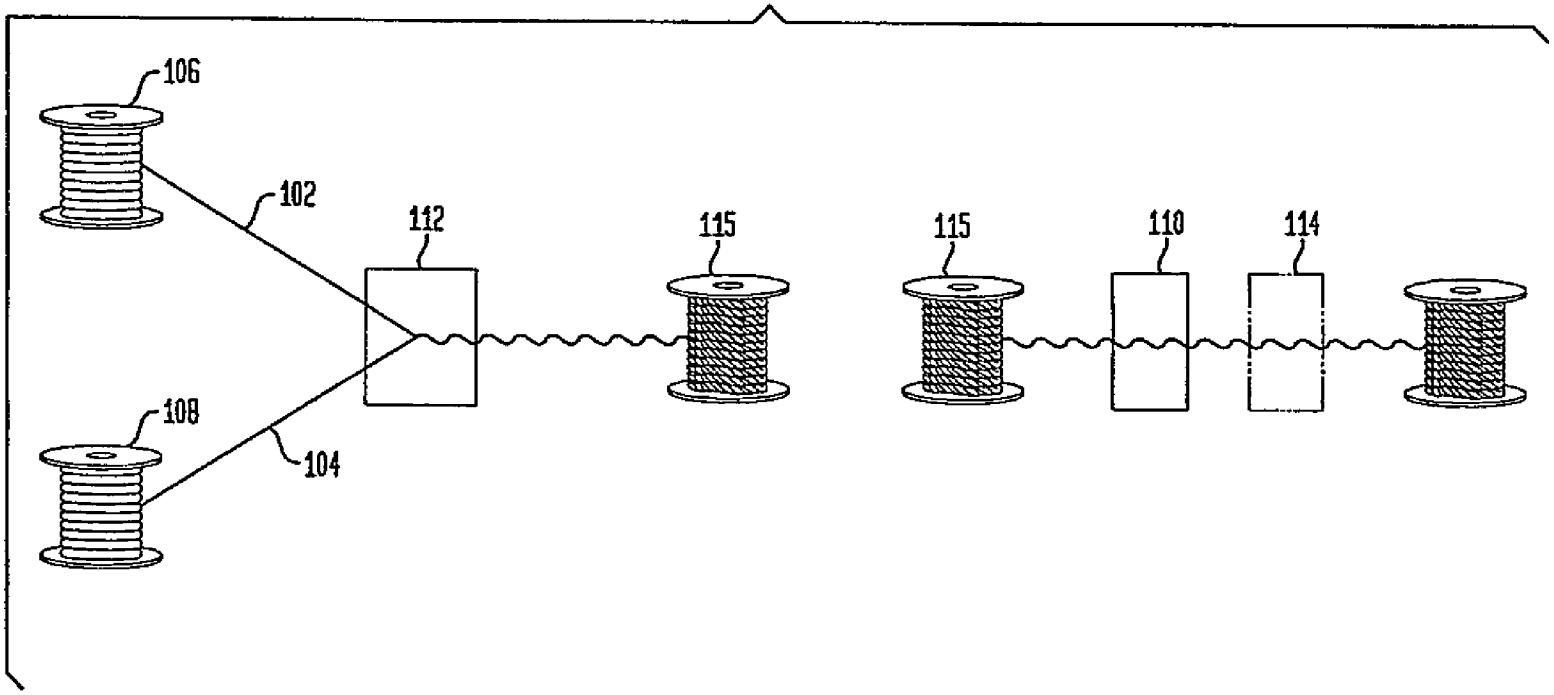

Referring to FIG. 6, there is provided a filament twisting apparatus 112 and an oven 110 for heat setting the twisted yarn in accordance with another example of the present invention. As shown, polymer strands 102 and 104 are twisted at room temperature by the filament twisting apparatus 112 and the twisted composite yarn is then wound to a spool 115. The twisted composite yarn is then unwound from the spool 115 into the oven 110 for heat setting, preferably below the melting temperature of the yarn, more preferably at a yarn surface temperature of lower than about 260° F., and the most preferably lower than about 250° F. The heat set twisted composite yarn is subject to air-cooling, or optionally, passed through a cooling device 114, and rewound to spool 116.

Although the individual strands of twisted yarn 100 have been heat set, the woven material itself, as well as the twisted yarn 100 wrapped about the front and back legs 134, 136, 138, 140 are not heat set. As a result, the individual strands of twisted yarn 100 can shift within the weave or about the legs during use of the chair 120. Over time, this can detract from the aesthetics of the chair.

The entire chair 120 can be placed into an oven similar to oven 110 in order to heat set the attached woven material and wrapped yarn similar to that used in the production of the heat set twisted yarn. In the case of the chair 120, it is contemplated that the oven will be a batch oven, as opposed to a continuous oven 110 as described with respect to the manufacture of the twisted yarn 100. In this regard, the oven will typically be of sufficient size to hold a plurality of chairs 120. The chairs will remain in the oven at a predetermined temperature for a predetermined residence time to cause the twisted yarn and/or non-twisted yarn to reach about its softening temperature or above, whereby contiguous portions of the twisted yarn 100 and non-twisted yarn 101 will bond or fuse together within the weave and wrapped portions when the chair is removed from the oven and allowed to cool. The cooling process may take place either within the oven or outside the oven by being subjected to ambient air. In addition, it is also contemplated that a source of chilled air may be blown over the heated chairs 120 either in a confined housing or in an open area. The temperature and residence time for the oven for heat setting the woven polymer material are similar to those as thus far described with respect to the twisted yarn. Thus, it is to be understood, that various constructions of polymer filaments may be woven to form the woven material having various aesthetic appearances.

Although in accordance with the preferred embodiment, the woven material is formed in situ on the frame, it is contemplated that panels of pre-woven material may be adhered to the frame and subsequently heat set, if desired, by placing the article of furniture in an oven as thus far described. It is therefore contemplated that portions of the article of furniture may be formed with woven material in situ, other portions by attaching panels of pre-woven material thereto, as well as variations thereof. In any event, the article of furniture can be placed in an oven to heat set the woven material and any wrapped portions of the article with the polymer strands of twisted and non-twisted strands.

The present invention has thus far been described by heating at least one of the elongated strands 102, 104 of polymer material to about its softening temperature whereby the strands upon twisting adhere to one another to prevent their unraveling. The twisting process may occur either before or after the heating process. The heating may take place either in an oven 110 or as a result of the strands 102, 104 being formed by hot extrusion of the polymer material through a die. In either case, at least one of the strands 102, 104 has been heated to approximately its softening temperature for adhering to the other strand upon cooling.

It is generally known that polymer materials can possess shape memory characteristics. This shape retention characteristic is dependent upon the nature and temperature of the polymer material. It is contemplated that this property can be utilized to form a twisted polymer yarn without the need of heating at least one strand to about its softening temperature whereby the strands will adhere to each other. By way of example, by heating at least one, and preferably both of the strands 102, 104, to a temperature of between 100°–200° F. prior to twisting, the heated strands upon cooling will essentially maintain their twisted configuration.

It is contemplated that the slight heating of at least one strand will allow the strand to relax so as to twist with an additional strand, and retain its twisted shape upon cooling. The heating will provide the strand with a sufficient heat set to retain its shape. In accordance with this embodiment, it is not a requirement of the present invention that the strands 102, 104 be adhered to each other along a portion of their length such as by heating at least one of the strands to its softening temperature or above where the two strands are integrally bonded or joined together. The heat setting of the twisted yarn in accordance with this embodiment will be sufficient to prevent the strands 102, 104 from unraveling during the weaving process. However, the two strands 102, 104 can be stripped from each other by opening the twist and separating the two strands if desired. This is generally considered not possible when the strands are adhered to each other in accordance with the prior embodiment.

The strands 102, 104 may be heated prior to or after the twisting operation. In addition, the strands 102, 104 may be heated in one or more ovens to the same or different temperatures. In addition, the strands 102, 104 may be heated as a result of their hot extrusion from an extrusion die during their formation thereby eliminating the need for an oven.

Although the invention herein has been described with reference to particular embodiments, it is to be understood that these embodiments are merely illustrative of the principles and application of the present invention. It is therefore to be understood that numerous modifications may be made to the illustrative embodiments and that other arrangements may be devised without departing from the spirit and scope of the present invention as defined by the appended claims.

What is claimed is:

1. A weave forming a woven panel adapted for use in a user supporting article of furnitire for supporting a portion of the user's body, said weave comprising a plurality of elongated non-twisted polymer strands, and a plurality of elongated twisted polymer strands, said non-twisted strands and said twisted strands woven together forming said woven panel wherein said twisted and said non-twisted strands each have exposed upper surfaces, said non-twisted strands having portions of said exposed upper surfaces above portions of said exposed upper surfaces of said twisted strands.

2. The weave of claim 1, wherein each of said twisted strands comprise at least a pair of polymer strands twisted together.

3. The weave of claim 2, wherein the twisted polymer strands are twisted together over their entire length.

4. The weave of claim 1, wherein the number of non-twisted strands is the same as the number of twisted strands.

5. The weave of claim 1, wherein the number of non-twisted strands is different from the number of twisted strands.

6. The weave of claim 1, wherein each of said non-twisted strands are woven about said twisted strands.

7. A woven panel adapted for use in a user supporting article of furniture for supporting a portion of the user's body, said woven panel comprising a plurality of elongated non-twisted polymer warp strands, each of said warp strands comprising a single polymer strand, a plurality of elongated twisted polymer weft strands, each of said weft strands comprising at least two polymer strands twisted together over their entire length, said weft strands and said warp strands having an exposed upper surface, wherein said exposed upper surface of said warp strands is arranged above said exposed upper surface of said weft strands in said woven panel.

8. The woven pattern of claim 7, wherein the number of warp strands is the same as the number of weft strands.

9. The woven panel of claim 7, wherein the number of warp strands is different from the number of weft strands.

10. An article of furniture comprising a frame having the shape of an article of furniture, and a weave of polymer material attached to said frame, said weave comprising a plurality of elongated non-twisted polymer wrap strands and a plurality of elongated twisted polymer weft strands.

11. The article of claim 10, wherein each of said weft strands comprise at least a pair of polymer strands twisted together.

12. The article of claim 11, wherein the twisted polymer strands are twisted together over their entire length.

13. The article of claim 10, wherein the number of warp strands is the same as the number of weft strands.

14. The article of claim 10, wherein the number of warp strands is different from the number of weft strands.

15. The article of claim 10, wherein each of said warp strands are woven about said weft strands.

16. The article of claim 15, wherein said weft and warp strands have an exposed upper surface, said warp strands have said exposed upper surface above said exposed upper surface of said weft strands within said weave.

17. The article of claim 10, wherein said weave forms a back rest portion of said article of furniture.

18. The article of claim 10, wherein said weave forms a seat portion of said article of furniture.

19. An article of furniture comprising a frame having the shape of an article of furniture, and a woven portion of polymer material attached to said frame, said woven portion comprising a plurality of elongated non-twisted polymer warp strands, each of said warp strands comprising a single polymer strand, a plurality of elongated twisted polymer weft strands, each of said weft strands comprising at least two polymer strands twisted together over their entire length, said weft strands and said warp strands having an exposed upper surface, wherein said exposed upper surface of said warp strands are arranged above said exposed upper surface of said weft strands within said woven portion.

20. The article of claim 19, wherein the number of warp strands is the same as the number of weft strands.

21. The article of claim 19, wherein the number of warp strands is different from the number of weft strands.

22. The article of claim 19, wherein said weave forms a back rest portion of said article of furniture.

23. The article of claim 19, wherein said weave forms a seat portion of said article of furniture.

24. A method of making an article of furniture comprising providing a frame having the shape of an article of furniture, providing a plurality of weft yarns of twisted polymer strands, weaving a plurality of warp yarns of non twisted polymer strands with said plurality of weft yarns to form a woven material, adhering said plurality of weft yarns and warp yarns to said frame, wherein said plurality of weft yarns and said warp yarns have ah exposed upper surface, wherein the exposed upper surface of said warp yarns are arranged above the upper surface of adjacent weft yarns.

25. The method of claim 24, wherein said plurality of warp and weft yarns are attached to said frame prior to weaving said plurality of warp yarns.

26. The method of claim 24, wherein said woven material is formed prior to attaching said plurality of warp and weft yarns to said frame.

* * * * *

UNITED STATES PATENT AND TRADEMARK OFFICE

CERTIFICATE OF CORRECTION

PATENT NO. : 6,935,383 B2
DATED : August 30, 2005
INVENTOR(S) : Larry Schwartz

It is certified that error appears in the above-identified patent and that said Letters Patent is hereby corrected as shown below:

Column 1,
Line 28, delete “into”.
Line 62, “non foamed” should read -- non-foamed --.

Column 3,
Line 12, after “comprising” insert -- a --.
Line 22, delete “of” (first occurrence) and insert therefor -- with --.
Line 27, “non twisted” should read -- non-twisted --.

Column 4,
Line 41, delete “their” and insert therefor -- its --.
Line 44, “do” should read -- does --.
Line 44, delete “their” and insert therefor -- the --.

Column 6,
Line 45, after “yarn” (second occurrence) insert -- , --.

Column 9,
Line 19, “comprise” should read -- comprises --.
Line 29, delete “are” and insert therefor -- is --.
Line 49, delete “wrap” and insert therefor -- warp --.
Line 52, “comprise” should read -- comprises --.

UNITED STATES PATENT AND TRADEMARK OFFICE

CERTIFICATE OF CORRECTION

PATENT NO. : 6,935,383 B2
DATED : August 30, 2005
INVENTOR(S) : Larry Schwartz

It is certified that error appears in the above-identified patent and that said Letters Patent is hereby corrected as shown below:

Column 10,
Lines 8, 26 and 44, delete “are” and insert therefor -- is --.
Line 39, “non twisted” should read -- non-twisted --.
Line 43, delete “ah” and insert therefor -- an --.

Signed and Sealed this

Twenty-ninth Day of November, 2005

JON W. DUDAS
*Director of the United States Patent and Trademark Office*

UNITED STATES PATENT AND TRADEMARK OFFICE

CERTIFICATE OF CORRECTION

PATENT NO. : 6,935,383 B2
APPLICATION NO. : 10/158629
DATED : August 30, 2005
INVENTOR(S) : Larry Schwartz It is certified that error appears in the above-identified patent and that said Letters Patent is hereby corrected as shown below:

TITLE PAGE SHOULD BE DELETED AND SUBSTITUTE THEREFORE THE ATTACHED TITLE PAGE.

PLEASE REPLACE THE FORMAL DRAWINGS WITH THE ATTACHED SIX (6) SHEETS FORMAL DRAWINGS.

Signed and Sealed this

Seventeenth Day of July, 2007

JON W. DUDAS
*Director of the United States Patent and Trademark Office*

(12) United States Patent
Schwartz

(10) Patent No.: US 6,935,383 B2
(45) Date of Patent: Aug. 30, 2005

(54) COMBINATION WEAVE USING TWISTED AND NONTWISTED YARN

(75) Inventor: Larry Schwartz, Boca Raton, FL (US)

(73) Assignee: Sun Isle Casual Furniture, LLC, Franklin Lakes, NJ (US)

( * ) Notice: Subject to any disclaimer, the term of this patent is extended or adjusted under 35 U.S.C. 154(b) by 98 days.

(21) Appl. No.: 10/158,629

(22) Filed: May 30, 2002

(65) Prior Publication Data

US 2003/0221741 A1 Dec. 4, 2003

Related U.S. Application Data

(63) Continuation-in-part of application No. 10/123,943, filed on Apr. 17, 2002, now Pat. No. 6,725,640, which is a continuation-in-part of application No. 10/073,634, filed on Feb. 11, 2002, now Pat. No. 6,705,070, which is a continuation-in-part of application No. 10/062,905, filed on Jan. 31, 2002, now Pat. No. 6,625,970

(60) Provisional application No. 60/336,819, filed on Dec. 5, 2001.

(51) Int. Cl.[7] ..... D03D 15/02

(52) U.S. Cl. ..... 139/426 TW; 139/383 R; 139/420 A

(58) Field of Search ..... 139/426 TW, 383 R, 139/420 A, 426 R

(56) References Cited

U.S. PATENT DOCUMENTS

| | | | | |
|---|---|---|---|---|
| 2,321,746 | A | | 6/1943 | Heymann |
| 2,400,276 | A | * | 5/1946 | Whitman ..... 442/189 |
| 2,713,360 | A | * | 7/1955 | Bloch et al. ..... 139/391 |
| 3,101,522 | A | | 8/1963 | Hooper et al. |
| 3,488,934 | A | | 1/1970 | MacDonald |
| 3,559,390 | A | | 2/1971 | Staschewski |
| 3,691,748 | A | | 9/1972 | Buzzao |
| 3,792,899 | A | | 2/1974 | Rocchia et al. |

(Continued)

FOREIGN PATENT DOCUMENTS

| | | |
|---|---|---|
| DE | 19516174 | 11/1996 |
| EP | 0210710 | 2/1987 |
| EP | 03732311 | 6/1990 |
| GB | 1047156 | 11/1980 |
| JP | 57133212 | 8/1982 |
| JP | 11179705 | 7/1999 |

*Primary Examiner*—John J. Calvert
*Assistant Examiner*—Robert H. Muromoto, Jr.
(74) *Attorney, Agent, or Firm*—Lerner, David, Littenberg, Krumholz & Mentlik, LLP

(57) ABSTRACT

An article of furniture is made from elongated polymer filaments. The polymer filaments may be monofilaments or plural filaments, which are twisted together and woven with polymer strands of non-twisted yarn to form a woven portion of material. The woven portion can be used to form the seat or back rest of a seating article of furniture for indoor or outdoor use.

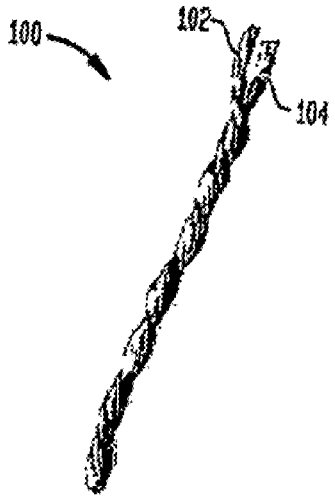

26 Claims, 6 Drawing Sheets